US008202236B2

(12) United States Patent
Gasbarro

(10) Patent No.: US 8,202,236 B2
(45) Date of Patent: Jun. 19, 2012

(54) METHODS FOR ENHANCING PRESSURE ACCURACY IN A COMPRESSION PUMP

(75) Inventor: James Gasbarro, Pittsburgh, PA (US)

(73) Assignee: Wright Therapy Products, Inc., Oakdale, PA (US)

( * ) Notice: Subject to any disclaimer, the term of this patent is extended or adjusted under 35 U.S.C. 154(b) by 1211 days.

(21) Appl. No.: 11/952,761

(22) Filed: Dec. 7, 2007

(65) Prior Publication Data

US 2009/0145234 A1 Jun. 11, 2009

(51) Int. Cl.
*A61H 7/00* (2006.01)

(52) U.S. Cl. ..... 601/148; 601/149

(58) Field of Classification Search ..... 601/148–152; 602/13; 5/600, 710, 713
See application file for complete search history.

(56) References Cited

U.S. PATENT DOCUMENTS

| | | | |
|---|---|---|---|
| 4,013,069 | A | 3/1977 | Hasty |
| 4,086,920 | A | 5/1978 | Miniere |
| 4,338,923 | A | 7/1982 | Gelfer et al. |
| 4,762,121 | A | 8/1988 | Shienfeld |
| 4,773,397 | A | 9/1988 | Wright et al. |
| 4,865,020 | A | 9/1989 | Bullard |
| 4,922,893 | A | 5/1990 | Wright et al. |
| 5,014,681 | A | 5/1991 | Neeman et al. |
| 5,117,812 | A | 6/1992 | McWhorter |
| 5,263,473 | A | 11/1993 | McWhorter |
| 5,437,610 | A | 8/1995 | Cariapa et al. |
| 5,496,262 | A | 3/1996 | Johnson, Jr. et al. |
| 5,591,200 | A | 1/1997 | Cone et al. |
| 5,830,164 | A | 11/1998 | Cone et al. |
| 5,843,007 | A | 12/1998 | McEwen et al. |
| 5,891,065 | A | 4/1999 | Cariapa et al. |
| 5,968,073 | A | 10/1999 | Jacobs |
| 6,007,559 | A | 12/1999 | Arkans |
| 6,010,471 | A | 1/2000 | Ben-Noon |
| 6,080,120 | A | 6/2000 | Sandman et al. |
| 6,135,116 | A | 10/2000 | Vogel et al. |
| 6,179,796 | B1 | 1/2001 | Waldridge |
| 6,231,532 | B1 | 5/2001 | Watson et al. |
| 6,296,617 | B1 | 10/2001 | Peeler et al. |
| 6,315,745 | B1 | 11/2001 | Kloecker |
| 6,406,445 | B1 | 6/2002 | Ben-Nun |
| 6,436,064 | B1 | 8/2002 | Kloecker |
| 6,440,093 | B1 | 8/2002 | McEwen et al. |
| 6,494,852 | B1 | 12/2002 | Barak et al. |
| 6,558,338 | B1 | 5/2003 | Wasserman |
| 6,645,165 | B2 | 11/2003 | Waldridge et al. |
| 6,786,879 | B1 | 9/2004 | Bolam et al. |
| 6,846,295 | B1 | 1/2005 | Ben-Nun |
| 6,852,089 | B2 | 2/2005 | Kloecker et al. |
| 6,860,862 | B2 | 3/2005 | Waldridge et al. |
| 6,893,409 | B1 | 5/2005 | Lina |
| 6,945,944 | B2 | 9/2005 | Kuiper et al. |
| 6,966,884 | B2 | 11/2005 | Waldridge et al. |

(Continued)

*Primary Examiner* — Michael A. Brown
(74) *Attorney, Agent, or Firm* — Pepper Hamilton LLP

(57) ABSTRACT

A method of measuring pressure for a cell in a pneumatic compression device may include performing an inflate/exhaust cycle including, for one or more cells of a plurality of cells in a pneumatic compression device, inflating a cell to a target pressure, wherein the target pressure is based on at least a desired pressure, measuring a pressure of the cell, determining an overpressure value associated with the cell based on at least the measured pressure, determining a subsequent target pressure associated with the cell based on at least the measured pressure and the overpressure value, deflating the cell, and inflating the cell until the subsequent target pressure is achieved.

17 Claims, 2 Drawing Sheets

U.S. PATENT DOCUMENTS 7,063,676 B2 6/2006 Barak et al.
2004/0261182 A1* 12/2004 Biggie et al. ..... 5/713
2009/0007341 A1* 1/2009 Roff et al. ..... 5/713
2009/0056020 A1* 3/2009 Caminade et al. ..... 5/600

* cited by examiner

METHODS FOR ENHANCING PRESSURE ACCURACY IN A COMPRESSION PUMP

BACKGROUND

Diseases such as lymphedema and venous insufficiency can often result in the pooling of bodily fluids in areas of the body distal from the heart. Venous insufficiency can result when the superficial veins of an extremity empty into the deep veins of the lower leg. Normally, the contractions of the calf muscles act as a pump, moving blood into the popliteal vein, the outflow vessel. Failure of this pumping action can occur as a result of muscle weakness, overall chamber size reduction, valvular incompetence and/or outflow obstruction. Each of these conditions can lead to venous stasis and hypertension in the affected area.

Fluid accumulation can be painful and debilitating if not treated. Fluid accumulation reduce oxygen transport, interfere with wound healing, provide a medium that supports infections or even result in the loss of a limb if left untreated.

Compression devices are often used in the treatment of venous insufficiency by moving the accumulated bodily fluids. Compression devices that improve pressure accuracy by using a pressure lookup table to account for a pressure drop in one or more valves are known in the art and are described in, for example, U.S. patent application Ser. No. 11/745,700.

A pressure lookup table compensates for a pressure difference at a transducer and a device cell. As pressure drop is a function of the desired pressure, a lookup table may be utilized to determine the pressure offset for a given setting. This method effectively improves pressure accuracy when inflating a single cell, however there is a significant effect on a particular cell's pressure when subsequent cells are inflated. This typically results in an undesirable overpressure condition where a cell's pressure rises substantially above the desired value.

SUMMARY

Before the present methods are described, it is to be understood that this invention is not limited to the particular systems, methodologies or protocols described, as these may vary. It is also to be understood that the terminology used herein is for the purpose of describing particular embodiments only, and is not intended to limit the scope of the present disclosure which will be limited only by the appended claims.

It must be noted that as used herein and in the appended claims, the singular forms "a," "an," and "the" include plural reference unless the context clearly dictates otherwise. Thus, for example, reference to a "cell" is a reference to one or more cells and equivalents thereof known to those skilled in the art, and so forth. Unless defined otherwise, all technical and scientific terms used herein have the same meanings as commonly understood by one of ordinary skill in the art. As used herein, the term "comprising" means "including, but not limited to."

In an embodiment, a method of measuring pressure for a cell in a pneumatic compression device may include performing an inflate/exhaust cycle including, for one or more cells of a plurality of cells in a pneumatic compression device, inflating a cell to a target pressure, wherein the target pressure is based on at least a desired pressure, measuring a pressure of the cell, determining an overpressure value associated with the cell based on at least the measured pressure, determining a subsequent target pressure associated with the cell based on at least the measured pressure and the overpressure value, deflating the cell, and inflating the cell until the subsequent target pressure is achieved.

In an embodiment, a method of measuring pressure for a cell in a pneumatic compression device may include performing a first inflate/exhaust cycle based on a desired pressure associated with one or more cells in a plurality of cells in a pneumatic compression device and performing a second inflate/exhaust cycle. The second inflate/exhaust cycle may include, for one or more cells of the plurality of cells, inflating a cell to a target pressure, measuring a pressure of the cell, determining an overpressure value associated with the cell based on at least the measured pressure, determining a subsequent target pressure associated with the cell based on at least the measured pressure and the overpressure value, deflating the cell, and inflating the cell until the subsequent target pressure is achieved.

In an embodiment, a method of measuring pressure for a cell in a pneumatic compression device may include performing a first inflate/exhaust cycle and second inflate/exhaust cycle. Performing a first inflate/exhaust cycle may include, for one or more cells in a plurality of cells in a pneumatic compression device, determining an adjustment pressure based on a desired pressure associated with a cell, inflating the cell to a target pressure wherein the target pressure is based on at least the adjustment pressure and the desired pressure, and deflating the cell. Performing a second inflate/exhaust cycle may include, for one or more cells of the plurality of cells, inflating the cell to the corresponding target pressure, measuring a pressure of the cell, determining an overpressure value associated with the cell based on at least the measured pressure, determining a subsequent target pressure associated with the cell based on at least the measured pressure and the overpressure value, deflating the cell, and inflating the cell until the subsequent target pressure is achieved.

DETAILED DESCRIPTION

The following terms shall have, for the purposes of this application, the meanings set forth below.

A "desired pressure" is a pressure associated with a cell in a pneumatic compression device.

An "adjustment pressure" is an amount by which the desired pressure may be increased to compensate for a pressure drop between a cell and the transducer.

A "target pressure" is an amount equal to the sum of the desired pressure and the adjustment pressure.

An "overpressure value" is an amount by which a cell's pressure exceeds the desired pressure value. For example, if a cell's desired pressure is 0.5 kPa and the cell's measured pressure is 0.75 kPa, the overpressure value associated with the cell is 0.25 kPa.

A "puff effect pressure" is an amount by which a cell's pressure may be increased due to the pressure measurement process.

A "subsequent target pressure" is a pressure value associated with a cell for the next inflation cycle.

Figure 1:
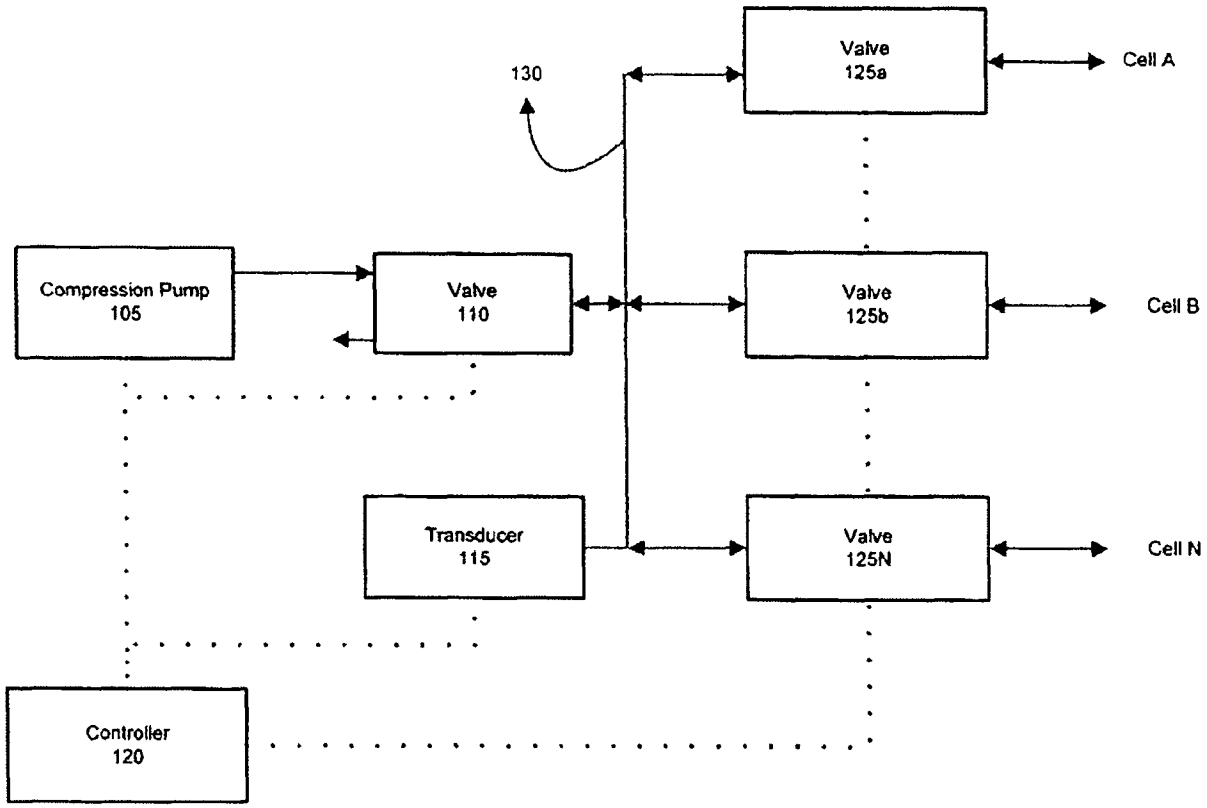
FIG. 1 depicts an exemplary pneumatic compression device according to an embodiment.

FIG. 1 depicts an exemplary pneumatic compression device according to an embodiment. As shown in FIG. 1, the pneumatic compression device may include a compression pump 105, a fill/exhaust valve 110, a transducer 115, a controller 120 and a plurality of cell valves, such as 125*a*-N. The compression pump 105 may be used to provide a pressurized fluid, such as pressurized air, water, saline or the like. The fill/exhaust value 110 may be connected to the compression pump 105 to receive the pressurized fluid. During an inflation period, the fill/exhaust valve 110 may be used to connect the output of the compression pump 105 to a common node or manifold 130. During a deflation period, the fill/exhaust valve 110 may connect the common manifold 130 to, for example, the atmosphere. Each of the cell valves 125*a*-N may be connected to the common manifold 130 on a first side and a corresponding cell on a second side. Each cell valve 125*a*-N may be used to selectively connect or disconnect the corresponding cell to the common manifold 130.

The transducer 115 may be connected to and used to monitor the pressure on the common manifold 130. The controller 120 may receive information regarding the pressure detected by the transducer 115. Based on at least the received pressure information, the controller 120 may determine whether to open or close the fill/exhaust valve 110 and/or one or more of the cell valves 125*a*-N.

Figure 2:
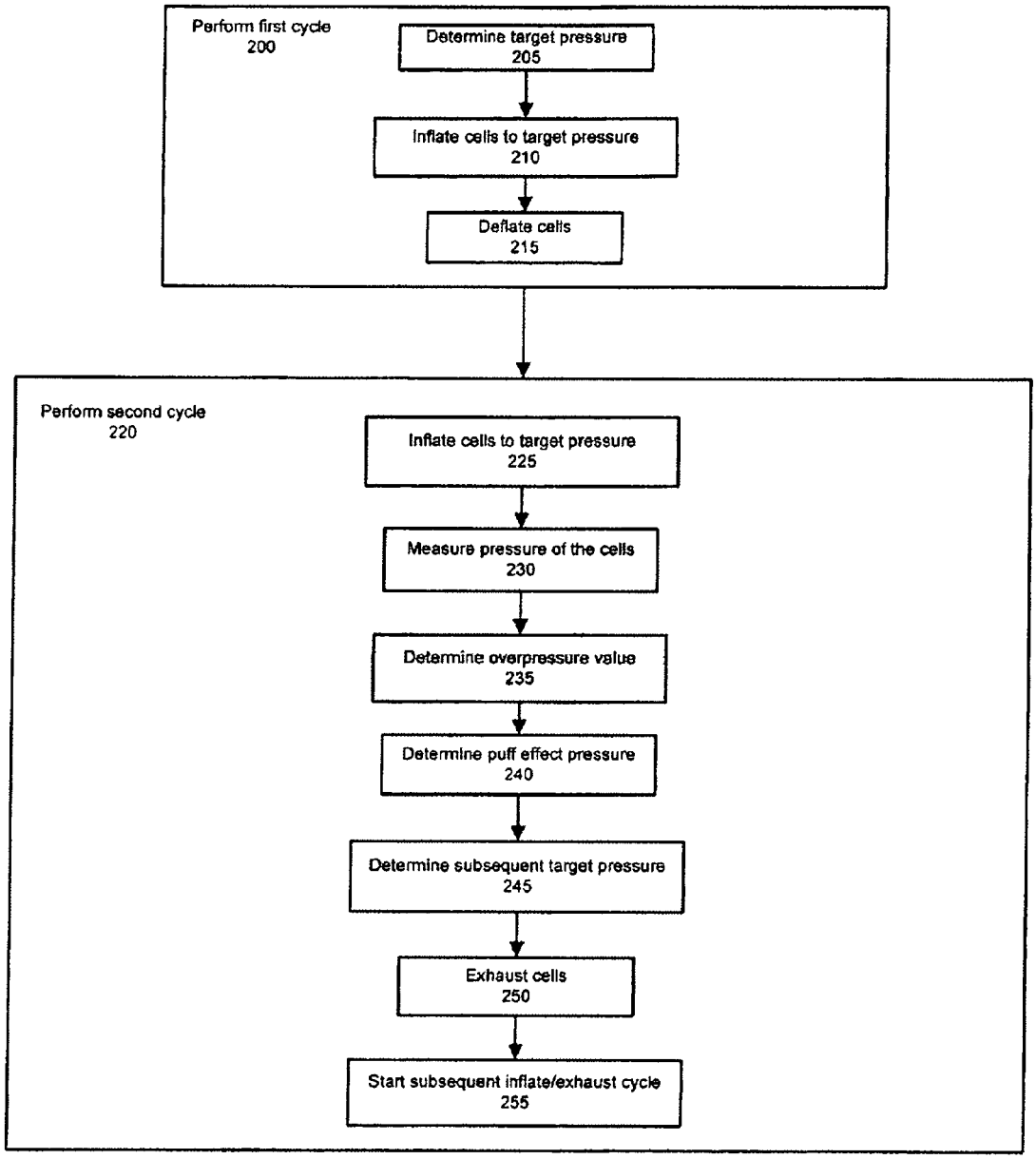
FIG. 2 depicts a flow diagram for an exemplary method of determining cell pressure according to an embodiment.

FIG. 2 depicts a flow diagram for an exemplary method of determining cell pressure according to an embodiment. A first inflate/exhaust cycle may be performed 200. To overcome the effect of a pressure drop between the cell and the transducer, it may be necessary to pressurize the fluid to a pressure exceeding the desired pressure. In an embodiment, a lookup table may be used to determine an adjustment pressure, or an amount by which to increase the desired pressure to compensate for the effect of pressure drop. The lookup table may be indexed by at least a desired pressure value. Table 1 illustrates an exemplary lookup table according to an embodiment. In an embodiment, the lookup table may include a range of desired pressure values and a corresponding adjustment pressure. In an embodiment, as illustrated by Table 1, as the desired pressure decreases the adjustment pressure may increase.

TABLE 1

| Desired Pressure (kPa) | Adjustment Pressure (kPa) |
|---|---|
| 10.0-10.5 | 0.5 |
| 9.5-10.0 | 0.7 |
| 9.0-9.5 | 0.8 |
| 8.5-9.0 | 1.0 |

In an embodiment, a target pressure may be determined 205. In an embodiment, the plurality of cells may be inflated 210 to a target pressure, or to a pressure equal to the sum of the desired pressure and the adjustment pressure. For example, if the desired pressure associated with a cell is 9.7 kPa, a lookup table, such as Table 1, may be utilized to determine the adjustment pressure associated with the desired pressure (i.e., 0.7 kPa), and the cell may be inflated to a target pressure of 10.4 kPa (i.e., 9.7 kPa+0.7 kPa) relative to the pressure transducer. In an embodiment, the controller may store the pressure value associated with the plurality of cells for use in subsequent inflate/exhaust cycles.

In an embodiment, after a plurality of cells are inflated 210 to their corresponding target pressure values, the cells may be deflated 215. This inflate/exhaust cycle may allow the compression device to stretch and conform to the surrounding environment.

In an embodiment, a second inflate/exhaust cycle may be performed 220. In an embodiment, a plurality of cells may be inflated 225 with a pressurized fluid having the target pressure associated with the cell. In an embodiment, the controller may retrieve the stored target pressure values associated with one or more cells determined during the first inflate/exhaust cycle. Alternatively, the target pressure values for the plurality of cells may be determined using a lookup table as described above.

Inflating a plurality of cells may result in overpressure in one or more cells because the pressure in a cell may influence the pressure of neighboring cells. Overpressure is an amount by which a cell's pressure exceeds the desired pressure value. The amount of overpressure may be influenced by a number of factors including, but not limited to, the size and construction of the device, the size of a limb within the device, the location of a cell within the device, the absolute pressure of a cell and the pressure differential between a cell and adjacent cells.

In an embodiment, the pressure of one or more cells may be measured 230 and the overpressure associated with one or more cells may be determined 235. In an embodiment, an overpressure value may be determined 235 by calculating the difference between the measured pressure and the target pressure associated with the cell. Table 2 depicts a table of exemplary overpressure values associated with cells.

TABLE 2

| Cell | Measured Pressure (kPa) | Target Pressure (kPa) | Overpressure |
|---|---|---|---|
| 1 | 0.72 | 0.5 | 0.22 |
| 2 | 1.73 | 1.6 | 0.13 |
| 3 | 2.28 | 2.3 | −0.02 |
| 4 | 1.81 | 1.7 | 0.11 |

As illustrated by Table 2, the target pressure associated with Cell 1 is 0.5 kPa and the measured pressure associated with Cell 1 is 0.72 kPa. As such, the overpressure associated with Cell 1 is the difference between the measured pressure and the target pressure associated with the cell (i.e., 0.22 kPa).

In an embodiment, because a compression device may have a limited number of valves, it may not be possible to statically measure the pressure in a cell. As discussed above, the pressure transducer 115 may monitor the pressure on the common manifold 130. A cell valve 125*a*-N must be opened to connect the cell to the valve manifold where the pressure transducer 115 is located, so the cell must either be filling or exhausting when its pressure is measured. As such, a pressure measurement may be required to be performed within a short time window to avoid additional overpressure.

A common method of measuring cell pressure includes setting the fill/exhaust valve to fill, opening the desired cell valve, waiting a short amount of time, such as, for example and without limitation, 0.5 seconds, to allow the pressure to stabilize, reading the output of the pressure transducer and closing the cell valve. Even though the amount of time that air is allowed into the cell while a cell valve is opened is relatively small, this puff of air may have an effect on the cell's measured pressure. This may be particularly true for small compression devices.

In an embodiment, a compensation table may be used to determine 240 a puff effect pressure that may be experienced by a cell during the pressure measuring process. A compensation table may include an array that may be indexed by, for example, a plurality of device sizes, a desired pressure value, a target pressure, a cell number and/or a time period for which the cell valve is open. In an embodiment, a user may provide an indication of the device size. The compensation table may include one or more puff effect pressures that correspond to the pressure increase due to the pressure measurement process. Table 3 illustrates an exemplary compensation table.

TABLE 3

| | Desired Pressure Range (kPa) | | | | |
|---|---|---|---|---|---|
| Size | 0.0-1.9 | 2.0-3.9 | 4.0-5.9 | 6.0-7.9 | 8.0-9.9 |
| X-Small | 0.4 | 0.3 | 0.2 | 0.1 | 0.1 |
| Small | 0.3 | 0.3 | 0.2 | 0.1 | 0.1 |
| Medium | 0.3 | 0.2 | 0.1 | 0.1 | 0.0 |
| Large | 0.2 | 0.1 | 0.1 | 0.0 | 0.0 |
| X-Large | 0.1 | 0.0 | 0.0 | 0.0 | 0.0 |

In an embodiment, subsequent target pressures may be determined 245 using the overpressure value and the measured pressure. A subsequent target pressure is a pressure associated with a cell for the next inflation cycle. In an embodiment, a subsequent target pressure may be the difference between the measured pressure and the overpressure value associated with a cell. For example, referring to Table 2, the subsequent target pressure for Cell 1 may be 0.28 kPa because this value is the difference between the measured pressure (i.e., 0.5 kPa) and the overpressure value (i.e., 0.22 kPa) associated with Cell 1.

In an embodiment, the puff effect pressure may be subtracted from the overpressure value to compensate for the overestimate of the overpressure due to the puff effect pressure. For example, if the puff effect pressure associated with Cell 1 is 0.1 kPa, then 0.1 kPa may be subtracted from the overpressure value (i.e., 0.22 kPa) to yield 0.12 kPa. This value may be subtracted from the measured pressure (i.e., 0.5 kPa) to yield a subsequent target pressure of 0.38 kPa.

In an embodiment, one or more cells may be exhausted 250 and a subsequent fill cycle may be started 255. In an embodiment, starting 255 a subsequent fill cycle may include filling one or more cells with a pressurized liquid having the subsequent target pressure associated with the cell.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method of measuring pressure for a cell in a pneumatic compression device, the method comprising:

performing an inflate/exhaust cycle comprising, for one or more cells of a plurality of cells in a pneumatic compression device:

inflating a cell to a target pressure, wherein the target pressure is based on at least a desired pressure, measuring a pressure of the cell, determining an overpressure value associated with the cell based on at least the measured pressure, determining a subsequent target pressure associated with the cell based on at least the measured pressure and the overpressure value, deflating the cell, and inflating the cell until the subsequent target pressure is achieved.

2. The method of claim 1, further comprising performing a second inflate/exhaust cycle comprising, for one or more cells of the plurality of cells:

determining an adjustment pressure for a cell based on the desired pressure for the cell by accessing a lookup table;

inflating the cell to the target pressure, wherein the target pressure comprises a sum of the desired pressure and the adjustment pressure; and deflating the cell.

3. The method of claim 1, wherein inflating the cell to a target pressure comprises:

determining an adjustment pressure based on the desired pressure associated with the cell by accessing a lookup table; and inflating the cell to the target pressure, wherein the target pressure is determined by summing the desired pressure and the adjustment pressure.

4. The method of claim 1, wherein determining an overpressure value comprises:

determining a difference between the target pressure and the measured pressure associated with the cell.

5. The method of claim 1, wherein determining a subsequent target pressure comprises:

determining a difference between the measured pressure and the overpressure value associated with the cell.

6. The method of claim 1, wherein determining a subsequent target pressure comprises:

determining a puff effect pressure using a compensation table;

determining an adjusted overpressure value by subtracting the puff effect pressure from the overpressure value; and determining a difference between the measured pressure and the adjusted overpressure value.

7. A method of measuring pressure for a cell in a pneumatic compression device, the method comprising:

performing a first inflate/exhaust cycle based on a desired pressure associated with one or more cells in a plurality of cells in a pneumatic compression device; and performing a second inflate/exhaust cycle comprising, for one or more cells of the plurality of cells:

inflating a cell to a target pressure, measuring a pressure of the cell, determining an overpressure value associated with the cell based on at least the measured pressure, determining a subsequent target pressure associated with the cell based on at least the measured pressure and the overpressure value, deflating the cell, and inflating the cell until the subsequent target pressure is achieved.

8. The method of claim 7, wherein performing a first inflate/exhaust cycle comprises, for one or more cells of the plurality of cells:

determining an adjustment pressure for a cell based on a desired pressure for the cell by accessing a lookup table;

inflating the cell to a target pressure determined by summing the desired pressure and the adjustment pressure; and deflating the cell.

9. The method of claim 7, wherein determining an overpressure value comprises:

determining a difference between the target pressure and the measured pressure associated with the cell.

10. The method of claim 7, wherein determining a subsequent target pressure comprises:

determining a difference between the measured pressure and the overpressure value associated with the cell.

11. The method of claim 7, wherein determining a subsequent target pressure comprises:

determining a puff effect pressure using a compensation table;

determining an adjusted overpressure value by subtracting the puff effect pressure from the overpressure value; and determining a difference between the measured pressure and the adjusted overpressure value.

12. A method of measuring pressure for a cell in a pneumatic compression device, the method comprising:

performing a first inflate/exhaust cycle comprising, for one or more cells in a plurality of cells in a pneumatic compression device:

determining an adjustment pressure based on a desired pressure associated with a cell, inflating the cell to a target pressure wherein the target pressure is based on at least the adjustment pressure and the desired pressure, and deflating the cell; and performing a second inflate/exhaust cycle comprising, for one or more cells of the plurality of cells:

inflating the cell to the corresponding target pressure, measuring a pressure of the cell, determining an overpressure value associated with the cell based on at least the measured pressure, determining a subsequent target pressure associated with the cell based on at least the measured pressure and the overpressure value, deflating the cell, and inflating the cell until the subsequent target pressure is achieved.

13. The method claim 12, wherein inflating the cell to a target pressure comprises:

determining the target pressure by summing the desired pressure and the adjustment pressure.

14. The method of claim 12, wherein determining an adjustment pressure comprises accessing a lookup table.

15. The method of claim 12, wherein determining an overpressure value comprises:

determining a difference between the measured pressure and the target pressure associated with the cell.

16. The method of claim 12, wherein determining a subsequent target pressure comprises:

determining a difference between the measured pressure and the overpressure value associated with the cell.

17. The method of claim 12, wherein determining a subsequent target pressure comprises:

determining a puff effect pressure by accessing a compensation table;

determining an adjusted overpressure value by subtracting the puff effect pressure from the overpressure value; and determining a difference between the measured pressure and the adjusted overpressure value.

* * * * *